US006280238B1

(12) United States Patent
Baker et al.

(10) Patent No.: US 6,280,238 B1
(45) Date of Patent: Aug. 28, 2001

(54) FULL-FACE ONE-PIECE JACKFIELD DESIGNATION PLATE

(75) Inventors: Daniel L. Baker; John E. Grant, both of Cambridge (CA)

(73) Assignee: AVP Mfg. & Supply Inc., Cambridge (CA)

( * ) Notice: Subject to any disclaimer, the term of this patent is extended or adjusted under 35 U.S.C. 154(b) by 0 days.

(21) Appl. No.: 09/501,579

(22) Filed: Feb. 10, 2000

(51) Int. Cl.[7] ..... H01R 3/00
(52) U.S. Cl. ..... 439/491
(58) Field of Search ..... 439/491, 488

(56) References Cited

U.S. PATENT DOCUMENTS

| | | | | |
|---|---|---|---|---|
| 4,707,564 | * | 11/1987 | Gonzales | 439/491 |
| 5,080,607 | * | 1/1992 | Cristescu | 439/491 |
| 5,613,874 | * | 3/1997 | Orlando et al. | 439/491 |
| 5,741,153 | * | 4/1998 | Schwer | 439/491 |
| 5,822,182 | * | 10/1998 | Scholder et al. | 439/491 |

OTHER PUBLICATIONS

AVP MFG & Supply Inc. Catalog 1999, "Audio/Video/Digital Jackfields".

* cited by examiner

*Primary Examiner*—Brian Sircus
*Assistant Examiner*—Javad Nasri
(74) *Attorney, Agent, or Firm*—R. Craig Armstrong

(57) ABSTRACT

A communication jackfield having a face plate, a plurality of jacks and a designation plate.

The designation plate is of a generally elongate flat shape, and has a plurality of jack barrel access holes, for allowing a front end of each of the jack barrels to protrude into respective jack barrel access hole, when jacks are mounted onto the face plate. The designation plate further has a first strip holder and a second strip holder, each strip holder having a longitudinal lower flange and a longitudinal upper flange arranged to securely hold a strip of information marking material. The designation plate covers substantially all of a front side of the face plate, and further has jack screw access holes arranged in conjunction with each jack barrel access hole. The designation plate front portion is generally in a same plane as an outer edge of the longitudinal upper and lower flanges, thereby allowing the strip holders to extend from an edge of the designation plate to the jack barrel access holes, to provide holding for extra wide strips.

21 Claims, 2 Drawing Sheets

FULL-FACE ONE-PIECE JACKFIELD DESIGNATION PLATE

BACKGROUND OF THE INVENTION

1. Field of the Invention

The invention relates to a designation plate for use with panel systems for communication jacks, also known as jackfields. A jack, as the term is used hereafter, is an individual female contact, for mechanical and electric cooperation with a corresponding male jack plug.

2. Description of the Prior Art

A jack-field is an array of jacks used to cross-patch audio, video or digital signals. The jackfield also serves as a test or monitoring point for these same signals. Jackfields are used anywhere considerable quantities of audio, digital or video signals need to be interconnected in varying configurations. The primary industries are telecommunications, broadcast, cable, duplicating and recording.

The jackfield usually has a generally flat face plate with a plurality of holes, one hole for each jack. The signals coming to and exiting the jackfield are interfaced at the rear of the jackfield. The communication jacks accept standard jack plug patch cords, to effect the desired interconnection, or patch, between two jacks at the front of the panel system. The jackfields are usually rack-mounted. Other names used to describe jackfields are patch-field, patch-bay, bay, audio bay or video bay.

The jacks are available in different types such as video, digital video, longframe audio and bantam audio. Longframe and bantam (TT) audio jacks are the most traditional of the types of jacks used in jackfields. They are used mainly for audio, digital audio and RS422 signal patching.

Typical installation of these jacks from inception to present day sees these jacks mounted into panels, the panels mounted into equipment racks. To provide the user with a possibility to label each jack connection on the panel, strip holders have been mounted above and below the rows of jacks. Each strip holder would accommodate a strip of paper or similar material, on which the user could write any preferred designations relating to the particular jack. Due to the fact that the jacks will have to be mounted onto the panel in some way, and the preferred method of doing this has traditionally been to screw the individual jack to the panel from the front of the panel, there has been a need to provide an unobstructed access to the mounting hole of the screw and the screw head. The access has either been a direct access to a free screw hole, or an access hole in the strip holder, if the strip holder was made wide enough to cover the jack mounting screw. However, the width of the patch cord jack plug handle has made it necessary to provide enough clearance between the jack plug handle and the strip holder, to ensure that the jack plug could be fully seated into the corresponding jack. This has effectively limited the width of the strip holder.

SUMMARY OF THE INVENTION

It is an object of the invention to provide a designation plate for use with panel system for communication jacks, which provides a wider strip holder than provided by traditional strip holders. Further features of the designation plate will be described below.

In the invention, a communication jackfield has a face plate, a plurality of jacks and a designation plate. The designation plate is of a generally elongate flat shape, and has a plurality of jack barrel access holes, for allowing a front end of each of the jack barrels to protrude into respective jack barrel access hole, when jacks are mounted onto the face plate. The designation plate further has a first strip holder and a second strip holder, each strip holder having a longitudinal lower flange and a longitudinal upper flange arranged to securely hold a strip of information marking material. The designation plate covers substantially all of a front side of the face plate, and further has jack screw access holes arranged in conjunction with each jack barrel access hole. The designation plate front portion is generally in a same plane as an outer edge of the longitudinal upper and lower flanges, thereby allowing the strip holders to extend from an edge of the designation plate to the jack barrel access holes, to provide holding for extra wide strips.

Thus, in one embodiment of the invention, a communication jackfield comprises

- a face plate, having a plurality of jack mounting holes, and jack screw holes adjacent the jack mounting holes;
- a plurality of jacks, having jack barrels arranged at a forward end of the jacks, each jack barrel being substantially cylindrical and arranged to receive the plug of a jack plug, the jacks are mountable in the jack mounting holes, so that a front end of each jack barrel protrudes from an outer surface of the face plate, and the jacks are fastenable to the face plate with jack screws arranged in the jack screw holes, so that each jack screw head rests on the face plate in a countersunk portion of the screw holes and each jack screw is accessible from a front of the face plate;
- a designation plate of a generally elongate flat shape, the designation plate having a front portion, a back portion, a first end, a second end, a top edge, a bottom edge and a plurality of jack barrel access holes, for allowing the front end of each jack barrel to protrude into respective jack barrel access hole, when jacks are mounted onto the face plate of the communication jackfield, the designation plate further having a first strip holder and a second strip holder, each strip holder having a longitudinal lower flange and a longitudinal upper flange arranged to securely hold a strip of information marking material, where the designation plate covers substantially all of a front side of the face plate, and the designation plate further comprises jack screw access holes arranged in conjunction with each jack barrel access hole, and where the designation plate front portion is generally in a same plane as an outer edge of the longitudinal upper flanges and an outer edge of the longitudinal lower flanges, thereby allowing the strip holders to extend from an edge of the designation plate to the jack barrel access holes, to provide holding for extra wide strips.

In a further preferred embodiment, a communication jackfield comprises:

- a face plate, having a plurality of upper jack mounting holes, lower jack mounting holes, upper jack screw holes adjacent the upper jack mounting holes and lower jack screw holes adjacent the lower jack mounting holes;
- a plurality of lower jacks and upper jacks, the lower jacks having lower jack barrels arranged at a forward end of the lower jacks, and the upper jacks having upper jack barrels arranged at a forward end of the upper jacks, each upper and lower jack barrel being substantially cylindrical and arranged to receive the plug of a jack plug, the lower and upper jacks being mountable in the upper and lower jack mounting holes, respectively, so that a front end of each jack barrel protrudes from an outer surface of the face plate, and fastenable to the face plate with jack screws arranged in the upper and lower jack screw holes, respectively, so that each jack screw head rests on the face plate in a countersunk portion of the upper and lower jack screw holes and each jack screw is accessible from a front of the face plate;

a designation plate of a generally elongate flat shape, the designation plate having a front portion, a back portion, a first end, a second end, a top edge and a bottom edge, the designation plate further having upper jack barrel access holes and lower jack barrel access holes, for allowing the front end of each jack barrel to protrude into respective upper and lower jack barrel access holes, when jacks are mounted onto the face plate of the communication jackfield, the designation plate further having an upper strip holder and a lower strip holder, the upper strip holder having a first longitudinal lower flange and a first longitudinal upper flange arranged to securely hold a strip of information marking material, and the lower strip holder having a second longitudinal lower flange and a second longitudinal upper flange arranged to securely hold a strip of information marking material, where the designation plate covers substantially all of a front side of the face plate, and the designation plate further comprises upper jack screw access holes arranged in conjunction with each upper jack barrel access hole and lower jack screw access holes arranged in conjunction with each lower jack barrel access hole, and where the designation plate front portion is generally in a same plane as an outer edge of the first and second longitudinal upper flanges and an outer edge of the first and second longitudinal lower flanges, thereby allowing the strip holders to extend from an edge of the designation plate to the jack barrel access holes, to provide holding for extra wide strips.

In yet a further embodiment of the invention, a designation plate of a generally elongate flat shape has a front portion, a back portion, a first end, a second end, a top edge, a bottom edge and a plurality of jack barrel access holes, the designation plate further having a first strip holder and a second strip holder, each strip holder having a longitudinal lower flange and a longitudinal upper flange arranged to securely hold a strip of information marking material, where the designation plate further comprises jack screw access holes arranged in conjunction with each jack barrel access hole, and wherein the designation plate front portion is generally in a same plane as an outer edge of the longitudinal upper flanges and an outer edge of the longitudinal lower flanges, thereby allowing the strip holders to extend from an edge of the designation plate to the jack barrel access holes, to provide holding for extra wide strips.

Optional in all embodiments are the following features:

The first strip holder preferably has one or more ribs protruding from the front portion of the designation plate, to enhance the hold on the strip without the use of further fastening means, and the second strip holder has one or more ribs protruding from the front portion of the designation plate, also to enhance the hold on the strip without the use of further fastening means.

Advantageously, the designation plate has one or more support ribs arranged on a side of the designation plate opposite the front portion, to provide support for the jacks as well as the designation plate as it presses onto the face plate.

Further, the designation plate preferably has as retaining means for colour-coding means, arranged on the front portion.

The designation plate may further have indication means arranged directly onto the front portion of the designation plate.

The designation plate is either made of an extruded material or made from several different pieces, which are joined together.

The invention provides the following advantages:

All of the module to panel mounting screws will be accessible from the front of the panel through access holes, thus module replacement is easier than for modules or jacks having rear mount screws. The user keeps a supply of modules and interchanges them as required. The modules will be color coded and indication means, for example colored plastic buttons, will be provided to be inserted onto the front of the panel, to indicate the type of circuit for that module position. Thus, the front mount modules makes module replacement very easy.

In order to accomplish the required front access screw holes, a special designation plate has been developed. The design of the strip maximizes the label size for the customer labeling by allowing the strip to be placed against the edge of the jack, without interfering with a patchcord plug. The design of the strip also makes alignment and assembly of the strip to the panel very quick, without the use of screws. Rather than being a single strip as is industry standard, it is a full face extrusion (for example), that affords separate strips above and below the two rows of jacks. It also acts as a retainer for the color-coding plastic buttons and also as a place to silkscreen jack position numbers. The designation holds the mounting screws captive, yet another feature provided by this strip.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 1:
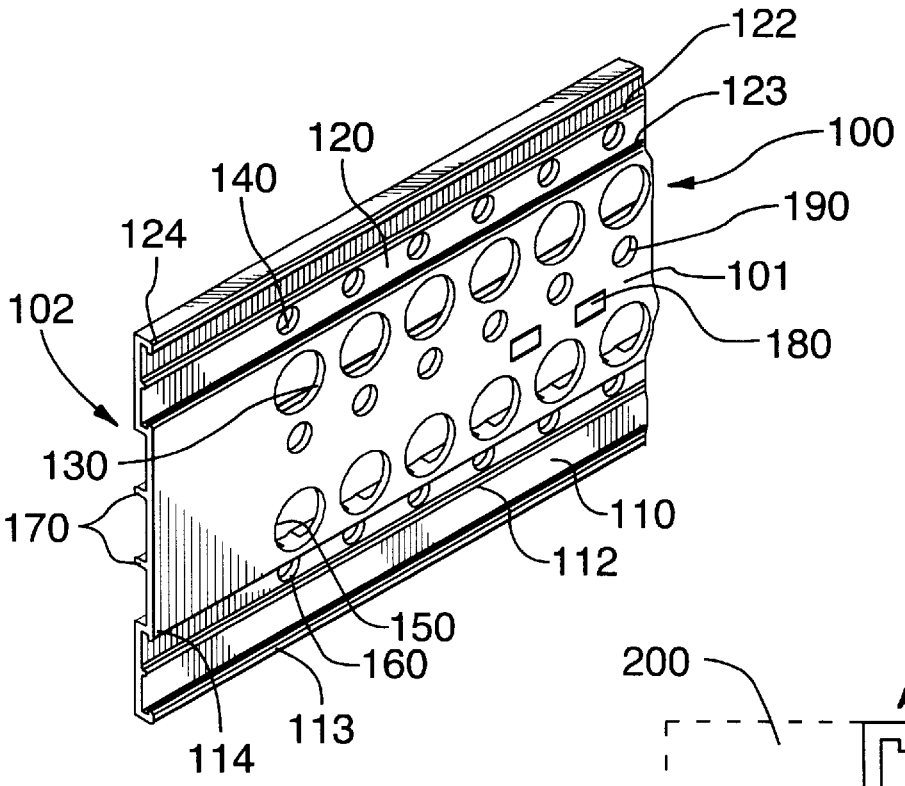
FIG. 1 is a schematic elevational side view of a jackfield designation plate according to the invention.
Figure 2:
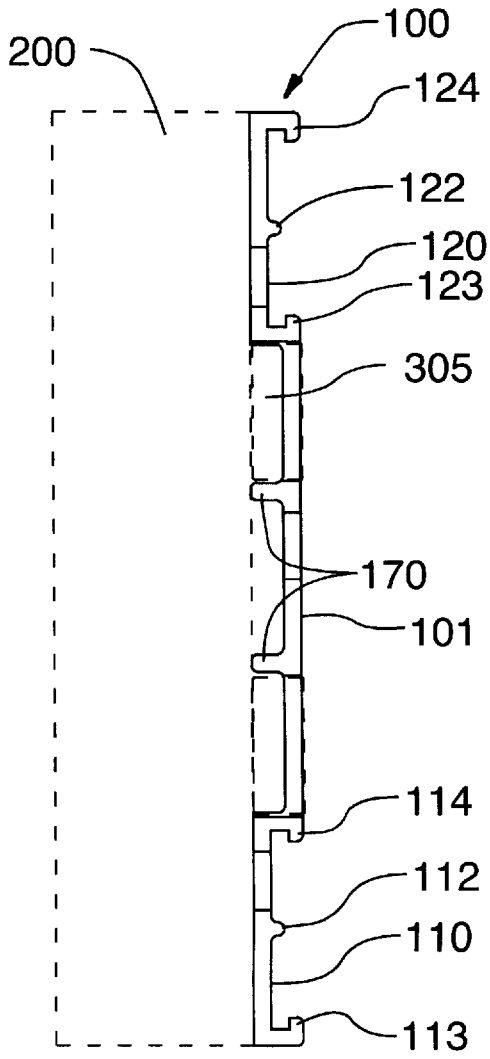
FIG. 2 is a side view of the jackfield designation plate according to FIG. 1.

According to the invention, to provide an enlarged surface area for the jackfield designation strips, a one-piece designation plate 100 is used. The designation plate is of a general elongate flat shape, preferably having a front portion 101, a back portion 102, a first end 103, a second end 104, a top edge 105 and a bottom edge 106. The designation plate 100 further has a plurality of upper jack barrel access holes 130, a plurality of lower jack barrel access holes 150, for allowing the front end of each jack barrel 305, 325 (see FIG. 3) to protrude into the respective jack barrel access hole 130, 150, when the jacks are mounted onto the face plate 200. The designation plate 100 is affixed to a front surface of the face plate 200, for example using glue or other suitable fastening means, so that each jack barrel access hole 130,150 lines up with the respective jack mounting hole 210 in the face plate.

Arranged in conjunction with each upper jack barrel access hole 130 are upper jack screw access holes 140, and with each lower jack barrel access hole 150 are lower jack screw access holes 160, to permit a screwdriver blade or similar tool to cooperate with the head of the upper jack screws 310 and lower jack screws 311, respectively, when the designation plate 100 is affixed to the face plate 200. Thus, the diameter of the jack screw access holes 140, 160 is smaller than the diameter of the head of the jack screws 310, 311. The jack screws are inserted into the respective jack screw hole 220, 230 before the designation plate 100 is affixed to the face plate 200. In this way, the jack screws are kept in place even when the jacks are not screwed tightly against the face plate, and there is no risk of losing the screws.

The designation plate 100 further comprises an upper strip holder 120 and a lower strip holder 110. The upper strip holder preferably has a first longitudinal lower flange 123 and a first longitudinal upper flange 124, arranged to securely hold a strip (not shown) of information marking material between them. The strip may comprise a paper material, for writing or printing information on, and an optional clear cover. Similarly, the lower strip holder preferably has a second longitudinal lower flange 113 and a second longitudinal upper flange 114, arranged to securely hold a strip (not shown) of information marking material between them. Advantageously, the upper strip holder 120 has one or more ribs 122 protruding from the front portion 101 of the designation plate 100, to enhance the hold on the strip without the use of further fastening means. Likewise, the lower strip holder 110 has one or more ribs 112 protruding from the front portion 101 of the designation plate 100, to enhance the hold on the strip without the use of further fastening means.

Optionally, the back portion 102 of the designation plate 100 may have one or more support ribs 170, to provide support for the jacks as well as the designation plate as it presses onto the face plate 200.

The designation plate 100 is preferably made of an extruded material, making it possible to manufacture the plate in one operation. Optionally, the designation plate may be manufactured from several different pieces, which are joined together.

Figure 3:
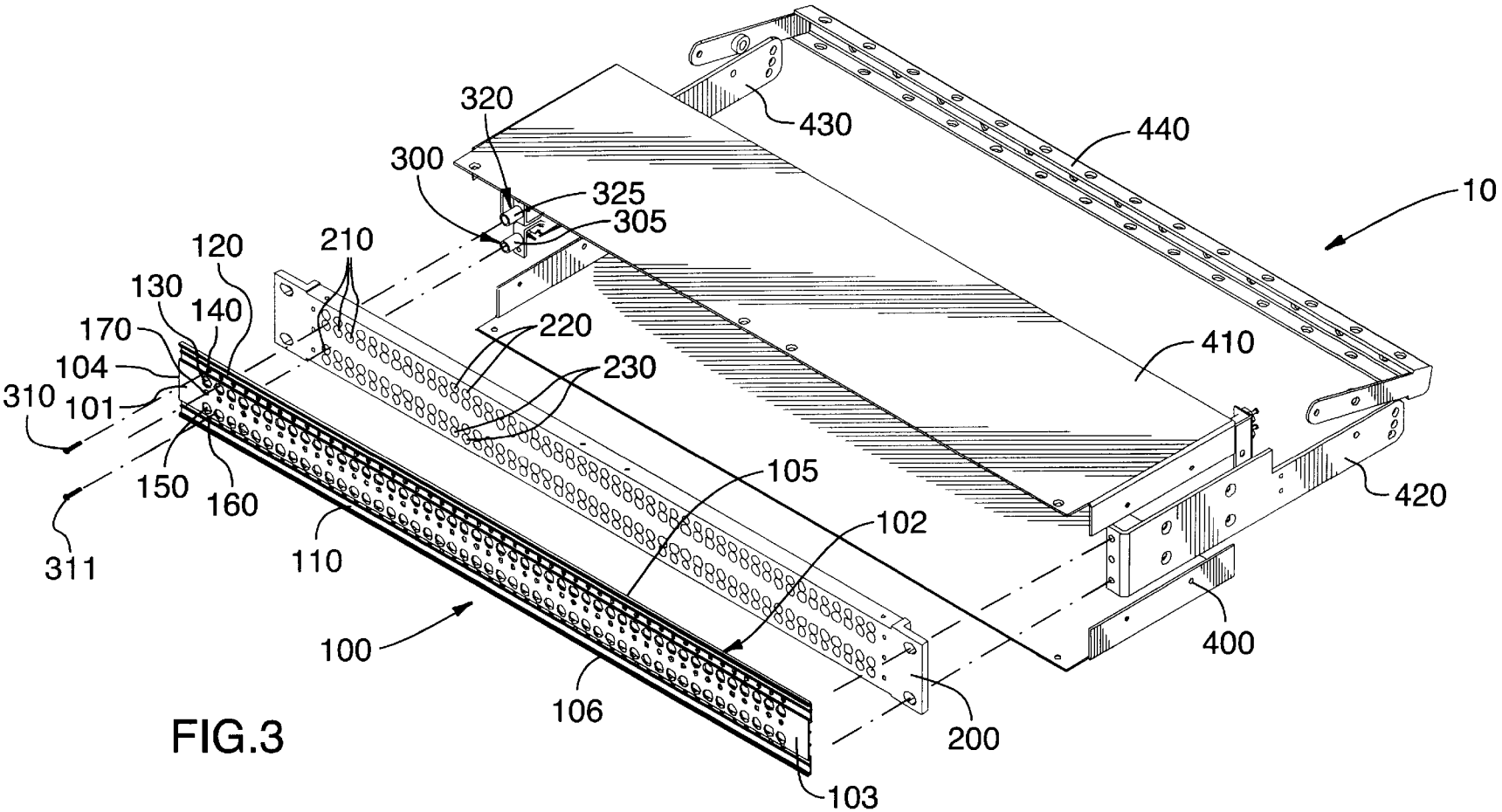
FIG. 3 is a schematic exploded elevational side view of a jackfield according to the invention.

FIG. 3 shows a jackfield 10 having a designation plate 100 according to an embodiment of the invention. A plurality of lower jacks 300 and upper jacks 320 are arranged in jack mounting holes 210 on a face plate 200. The lower jacks have lower jack barrels 305 arranged at a forward end of the jacks, and the upper jacks have upper jack barrels 325 arranged at a forward end of the jacks, each jack barrel being substantially cylindrical and arranged to receive the plug of a jack plug (not shown). The face plate further has upper jack screw holes 220 and lower jack screw holes 230 for accommodating upper jack screws 310 and lower jack screws 311, respectively. Each jack screw hole is countersunk (not shown) at the front of the face plate, to accommodate the heads of the jack screws. The jacks 300, 320 are inserted into the mounting holes 210 of the face plate 200, so that a front end of each jack barrel 305, 325 protrudes from an outer surface of the face plate. Each lower jack 300 is then fastened to the face plate via the lower screw 311, which is inserted from the front of the face plate and threaded into a mounting hole (not shown) arranged on the lower jack. Similarly, each upper jack 320 is fastened to the face plate via the upper screw 310, which is inserted from the front of the face plate and threaded into a mounting hole (not shown) arranged on the upper jack. Thus, two rows of jacks are formed, an upper row and a lower row, comprising a plurality of paired jacks.

In this way, the invention provides a designation plate having two strip holders which are substantially wider than the strip holders of the prior art, since the strip holder reaches from the edge of the jackfield face plate all the way up to the barrel of the jack. There is thus more space available for written or printed information on each strip. One strip is arranged above the two rows of jacks, and the other strip is arranged below the two rows of jacks. The designation plate also acts as a retainer for colour-coding means (not shown) attachable to colour-coding means mounting holes 190 arranged on the front portion of the designation plate. The colour-coding means are preferably plastic buttons that removably snap into the mounting holes. A further optional element are indication means 180 arranged directly onto the front portion of the designation plate, for example jack position numbers silk-screened onto the designation plate.

The jack holes of the designation plate are preferably slightly larger than the outside diameter of the jack barrels. The jacks are mounted to the face plate and tightened with the respective screw, thereafter the designation plate is mounted onto the face plate, the jack barrels acting as alignment points for the designation plate at the same time as any sagging of the designation plate during glue curing (or similar) is prevented.

It will be appreciated that the above description relates to the preferred embodiments by way of example only. Many variations on the invention will be obvious to those knowledgeable in the field, and such obvious variations are within the scope of the invention as described and claimed, whether or not expressly described.

What is claimed is:

1. A communication jackfield comprising:

a face plate, having a plurality of jack mounting holes, and jack screw holes adjacent said jack mounting holes;

a plurality of jacks, having jack barrels arranged at a forward end of said jacks, each said jack barrel being substantially cylindrical and arranged to receive a jack plug, said jacks being mountable in said jack mounting holes, so that a front end of each jack barrel protrudes from an outer surface of said face plate, and said jacks fastenable to said face plate with jack screws arranged in said jack screw holes, so that each jack screw head rests on said face plate in said jack screw holes and each jack screw is accessible from a front of said face plate;

a designation plate of a generally elongate flat shape, said designation plate having a front portion, a back portion, a first end, a second end, a top edge, a bottom edge and a plurality of jack barrel access holes, for allowing said front end of each said jack barrel to protrude into respective said jack barrel access holes, when jacks are mounted onto said face plate of said communication jackfield, said designation plate further having a first strip holder and a second strip holder, each strip holder having a longitudinal lower flange and a longitudinal upper flange arranged to securely hold a strip of information marking material, wherein said designation plate covers substantially all of a front side of said face plate, and said designation plate further comprises jack screw access holes arranged in conjunction with each jack barrel access hole, and wherein said designation plate front portion is generally in a same plane as an outer edge of said longitudinal upper flanges and an outer edge of said longitudinal lower flanges, thereby allowing said strip holders to extend from an edge of said designation plate to said jack barrel access holes, to provide holding for extra wide said strips.

2. The communication jackfield as recited in claim 1, wherein said first strip holder has one or more ribs protruding from said front portion of said designation plate, to enhance the hold on said strip without the use of further fastening means, and said second strip holder has one or more ribs protruding from said front portion of said designation plate, also to enhance the hold on said strip without the use of further fastening means.

3. The communication jackfield as recited in claim 2, wherein said designation plate has one or more support ribs arranged on a side of said designation plate opposite said front portion, to provide support for said jacks as well as said designation plate as it presses onto said face plate.

4. The communication jackfield as recited in claim 3, wherein said designation plate further has as retaining means for colour-coding means, arranged on said front portion.

5. The communication jackfield as recited in claim 4, wherein said designation plate further has indication means arranged directly onto the front portion of said designation plate.

6. The communication jackfield as recited in claim 5, wherein said designation plate is made of an extruded material.

7. The communication jackfield as recited in claim 5, wherein said designation plate is made from several different pieces, which are joined together.

8. A communication jackfield comprising:

a face plate, having a plurality of upper jack mounting holes, lower jack mounting holes, upper jack screw holes adjacent said upper jack mounting holes and lower jack screw holes adjacent said lower jack mounting holes;

a plurality of lower jacks and upper jacks, said lower jacks having lower jack barrels arranged at a forward end of said lower jacks, and said upper jacks having upper jack barrels arranged at a forward end of said upper jacks, each said upper and lower jack barrel being substantially cylindrical and arranged to receive a jack plug, said lower and upper jacks being mountable in said upper and lower jack mounting holes, respectively, so that a front end of each jack barrel protrudes from an outer surface of said face plate, and fastenable to said face plate with jack screws arranged in said upper and lower jack screw holes, respectively, so that each jack screw head rests on said face plate said upper and lower jack screw holes and each jack screw is accessible from a front of said face plate;

a designation plate of a generally elongate flat shape, said designation plate having a front portion, a back portion, a first end, a second end, a top edge and a bottom edge, said designation plate further having upper jack barrel access holes and lower jack barrel access holes, for allowing said front end of each said jack barrel to protrude into respective said upper and lower jack barrel access holes, when jacks are mounted onto said face plate of said communication jackfield, said designation plate further having an upper strip holder and a lower strip holder, said upper strip holder having a first longitudinal lower flange and a first longitudinal upper flange arranged to securely hold a strip of information marking material, and said lower strip holder having a second longitudinal lower flange and a second longitudinal upper flange arranged to securely hold a strip of information marking material, wherein said designation plate covers substantially all of a front side of said face plate, and said designation plate further comprises upper jack screw access holes arranged in conjunction with each said upper jack barrel access hole and lower jack screw access holes arranged in conjunction with each lower jack barrel access hole, and wherein said designation plate front portion is generally in a same plane as an outer edge of said first and second longitudinal upper flanges and an outer edge of said first and second longitudinal lower flanges, thereby allowing said strip holders to extend from an edge of said designation plate to said jack barrel access holes, to provide holding for extra wide said strips.

9. The communication jackfield as recited in claim 8, wherein said upper strip holder has one or more ribs protruding from said front portion of said designation plate, to enhance the hold on said strip without the use of further fastening means, and said lower strip holder has one or more ribs protruding from said front portion of said designation plate, also to enhance the hold on said strip without the use of further fastening means.

10. The communication jackfield as recited in claim 9, wherein said designation plate has one or more support ribs arranged on a side of said designation plate opposite said front portion, to provide support for said jacks as well as said designation plate as it presses onto said face plate.

11. The communication jackfield as recited in claim 10, wherein said designation plate further has as retaining means for colour-coding means, arranged on said front portion.

12. The communication jackfield as recited in claim 11, wherein said designation plate further has indication means arranged directly onto the front portion of said designation plate.

13. The communication jackfield as recited in claim 12, wherein said designation plate is made of an extruded material.

14. The communication jackfield as recited in claim 12, wherein said designation plate is made from several different pieces, which are joined together.

15. A designation plate of a generally elongate flat shape, said plate having a front portion, a back portion, a first end, asecond end, a bottom edge and a plurality of jack barrel access holes, said designtion plate further having a first strip holder and a second strip holder, each strip holder having a longitudinal lower flange and a longitunal upper flange arranged to securely hold a strip of information marking material, wherein said designation plate further comprises jack screw access holes arranged in conjunction with each jack barrel access hole, and wherein said designation plate front portion is generally in a same plane as an outer edge of said longitudinal upper flanges and an outer edge of said longitudinal lower flanges, thereby allowing said strip holders to extend from an edge of said designation plate to said plate to said jack barrel access holes, to provide holding for extra wide said strips.

16. The designation plate as recited in claim 15, wherein said upper strip holder has one or more ribs protruding from said front portion of said designation plate, to enhance the hold on said strip without the use of further fastening means, and said lower strip holder has one or more ribs protruding from said front portion of said designation plate, also to enhance the hold on said strip without the use of further fastening means.

17. The designation plate as recited in claim 16, wherein said designation plate has one or more support ribs arranged on a side of said designation plate opposite said front portion.

18. The designation plate as recited in claim 17, wherein said designation plate further has as retaining means for colour-coding means, arranged on said front portion.

19. The designation plate as recited in claim 18, wherein said designation plate further has indication means arranged directly onto the front portion of said designation plate.

20. The designation plate as recited in claim 19, wherein said designation plate is made of an extruded material.

21. The designation plate as recited in claim 19, wherein said designation plate is made from several different pieces, which are joined together.

* * * * *